United States Patent [19]

Solidum et al.

[11] 3,935,005

[45] Jan. 27, 1976

[54] COMPOSITION AND METHOD FOR STRIPPING GOLD AND SILVER

[75] Inventors: Hamilton M. Solidum, North Attleboro, Mass.; Robert G. Zobbi, Southbury, Conn.

[73] Assignee: American Chemical & Refining Company, Incorporated, Waterbury, Conn.

[22] Filed: Sept. 19, 1974

[21] Appl. No.: 507,333

[52] U.S. Cl. ..... 75/105; 156/18; 156/19; 252/79.1; 75/107; 75/118 R

[51] Int. Cl.[2] ..... C09K 13/00; C23F 3/04

[58] Field of Search ..... 156/18, 19; 252/79.1; 75/105, 107, 118 R

[56] References Cited

UNITED STATES PATENTS

| | | | |
|---|---|---|---|
| 2,100,865 | 11/1937 | Mills et al. | 75/107 |
| 3,242,090 | 3/1966 | Grunwald | 156/18 |
| 3,649,250 | 3/1972 | Dorenfeld et al. | 75/107 |
| 3,816,317 | 6/1974 | MacArthur et al. | 156/18 |
| 3,819,494 | 6/1974 | Fountain | 75/105 |
| 3,846,124 | 11/1974 | Guay | 75/105 |

OTHER PUBLICATIONS

*Kirk-Othmer Encyclopedia of Chemical Technology*, 2nd Ed., Vol. 6, p. 599, (New York, N.Y.).

*Primary Examiner*—Douglas J. Drummond
*Assistant Examiner*—Jerome Massie

[57] ABSTRACT

A dry powder composition for stripping gold and silver contains 78.0–95.0 percent of a soluble cyanide compound, 0.01–5.0 percent of a soluble lithium compound, 0.01–0.5 percent of a soluble lead or bismuth compound as an auxiliary agent, and 5.0–22.0 percent of a water soluble ring-substituted nitrobenzene acid compound. The nitrobenzene acid compounds are selected from the group consisting of the alkali metal and ammonium salts of methyl-nitrobenzoic acid, chloro-nitrobenzoic acid and amino nitrobenzoic acid and of chloro-nitrobenzenesulfonamides. In using the composition, 7.5–60.0 grams per liter of the dry powder composition is dissolved inwater and the resultant aqueous solution is maintained at a temperature of 18°–55° Centigrade. The solution may be replenished as the stripping rate decreases by addition of further amounts of the dry powder composition.

11 Claims, No Drawings

COMPOSITION AND METHOD FOR STRIPPING GOLD AND SILVER

BACKGROUND OF THE INVENTION

Various compositions have been proposed for stripping metal coatings from workpieces of other metal onto which the coatings have been deposited by electroplating or chemical plating techniques. Frequently, it is found that there is an imperfection in the plated deposit, such as discoloration or poor adhesion, or an imperfection of the workpiece itself, which will require the removal of the plated deposit for reworking of the part or for recovery of the metal of the deposit. With the soaring cost of precious metals, it has become extremely important that plated deposits of such metals be removed completely and with minimum contamination so that the precious metal values may be recovered from the stripping solution conveniently and economically. Accordingly, it is extremely desirable that the stripping solution be one which will remove the precious metal or other plated metal deposit rapidly and completely without appreciably attacking the substrate.

In Grunwald U.S. Pat. No. 3,242,090, there is disclosed a gold stripping composition comprising a complex metal tetracyanide salt, a nitrosubstituted aromatic compound such as nitrobenzenesulfonic acid, nitobenzoic acid, nitrochlorobenzene, nitrophenol and nitrobenzaldehyde. The metal forming the complex of the patented composition is selected from the group consisting of zinc, cadmium and copper. Another prior art composition is disclosed in Springer et al. U.S. Pat. No. 2,649,361 and comprises sodium cyanide, sodium nitrobenzenesulfonate and sodium hydroxide. The compositions of the Grunwald patent and the Springer patent have enjoyed substantial utilization as strippers of gold from various types of substrates.

Generally, it has been found that such stripping compositions have not removed the metal deposits as rapidly as might be desirable and that there has been a tendency to attack various metal substrates. Moreover, there has been a continuing need to develop dry powder compositions permitting make-up of the aqueous stripping composition rapidly and easily with a minimum of danger to the operator. Lastly, there has been a continuing need for a composition which would operate at a high rate of speed at ambient to low elevated temperatures.

It is an object of the present invention to provide a novel dry powder composition which, upon admixture with water, will produce a highly effective solution for stripping gold and silver from various substrates.

It is also an object to provide such a composition which exhibits reasonably long shelf life and which is relatively economical.

It is a further object to provide a method for stripping gold and silver from various substrates which is conveniently and economically practiced using for initial make-up and for replenishment a dry powder composition.

Another object is to provide such a method in which gold values stripped from the substrate may be readily recovered on an economical basis.

SUMMARY OF THE INVENTION

It has now been found that the foregoing and related objects may be readily attained by use of a dry powder composition consisting essentially of, on a dry weight basis, 78.0–95.0 percent of a soluble cyanide compound selected from the group consisting of alkali metal cyanides, ammonium cyanide and mixtures thereof as an agent for chelating the metal values which are stripped from the substrate. The composition contains 0.01–5.0 percent of a soluble lithium compound to accelerate the stripping action and 0.01–0.5 percent of a soluble lead and/or bismuth compound which also appears to accelerate the stripping action. Lastly, the composition essentially contains 5.0–22.0 percent of a water soluble ring-substituted nitrobenzene acid compound selected from the group consisting of alkali metal and ammonium salts of methyl-nitrobenzoic acid, chloro-nitrobenzenesulfonamide, alkali metal and ammonium salts of amino nitrobenzoic acid, and alkali metal and ammonium salts of chloro-nitrobenzoic acid; this serves to oxidize the gold, palladium or nickel coatings and bring them into solution.

In the preferred compositions, the nitrobenzene acid compound is an alkali metal salt of 2-chloro-4-nitrobenzoic acid and the auxiliarly agent is a soluble lead salt. The soluble cyanide compound will most desirably comprise 80.0–85.0 percent by weight, the lithium compound 0.05–1.0 percent by weight, the auxiliary agent 0.05–0.25 percent by weight and the nitrobenzene acid compound 12.0–20.0 percent by weight.

In practicing the method, there is dissolved in water 7.5–60.0 grams per liter of the dry powder composition and the resultant aqueous solution is maintained at a temperature of 18°–55° Centigrade. A workpiece having a deposit of gold, nickel or palladium is immersed in the solution for a period of time sufficient to remove the metal deposit therefrom. Finally, the workpiece is rinsed to remove any residue of aqueous solution therefrom.

Preferably, the solution is maintained at a temperature of 25°–35° Centigrade and the dry powder composition is dissolved initially to provide a concentration of 25.0–35.0 grams per liter. In continuing use of the solution, there is periodically dissolved in the solution further amounts of 5.0–30.0 grams per liter of dry powder composition as the rate of stripping decreases until there has been dissolved in the aqueous solution a total of at least 150 grams per liter and not more than 200 grams per liter. To recover gold values from such a solution, the solution is subsequently treated to destroy the gold cyanide complex and precipitate a gold compound.

DETAILED DESCRIPTION OF THE PREFERRED EMBODIMENT

As has been hereinbefore indicated, the dry powder compositions of the present invention essentially include a soluble cyanide compound, a soluble lithium compound, a soluble lead or bismuth compound and a soluble ring-substituted nitrobenzene acid compound. Each of these several components will be discussed in greater detail hereinafter as will be the operating conditions and other factors.

Various water-soluble nitrobenzene acid compounds may be utilized to provide the desired oxidating agent which attacks the gold or silver deposit to effect dissolution thereof. Although a wide variety of such nitrobenzene acid compounds have been utilized in stripping compositions because of their known properties in this regard, a relatively limited class of such compounds have proven to be effective in the compositions of the present invention. More particularly, the usable compounds are the alkali metal and ammonium salts of methyl-nitrobenzoic acid (e.g., 3-methyl-6-nitrobenzoic acid · potassium salt; 3-methyl-2-nitrobenzoic acid · sodium salt); alkali metal and ammonium salts of chloro-nitrobenzoic acid (e.g., 2-chloro-4-nitrobenzoic acid · potassium salt; 4-chloro-3-nitrobenzoic acid · sodium salt); chloro-nitrobenzenesulfonamide (e.g., 4-chloro-3-nitrobenzenesulfonamide); and alkali metal and ammonium salts of amino-nitrobenzoic acid (e.g., 2-amino-4-nitrobenzoic acid · potassium salt). Although it is possible to use mixtures of the several classes and species of the nitrobenzene acid compounds, generally it has been found preferable to use only one of such compounds to avoid possible interactions. In stripping gold deposits, the preferred agents are the chloro-nitrobenzoate compounds and potassium 2-chloro-4-nitrobenzoate has proven highly effective. In stripping silver deposits, it is desirable to avoid the possible presence of chloride ion and the methyl-nitrobenzoates have been found most advantageously employed. The amount of the nitrobenzene acid compound may vary from as little as 5.0 percent of the dry powder composition to more than 20.0 percent with the preferred amounts being within the range of 15.0–20.0 percent. Amounts in excess of 22.0 percent by weight do not appear to provide any additional benefits in terms of stripping action and materially increase costs.

Any soluble lithium compound may be utilized to provide the lithium ion which serves to accelerate the stripping rate so long as its anion is non-interfering in the particular formulation and process. Thus, in preparing a composition for stripping gold, the suitable lithium compounds include lithium carbonate, lithium acetate, lithium chloride and lithium cyanide, while the lithium chloride would be undesirable in a composition for stripping silver. The amount of lithium compound may comprise as little as 0.01 percent by weight of the dry powder composition and may comprise as much as 5.0 percent and even more. However, amounts in excess of 5.0 percent do not appear to afford any advantage and materially increase costs. The preferred compositions utilize the lithium compound in the range of 0.05–1.0 percent and most desirably at about 0.1–0.5 percent.

The auxiliary agent comprising the lead or bismuth compound may be provided by any suitable lead or bismuth compound having an anion which is noninterfering in the process. Suitable anions include acetate, citrate, chloride and hydroxide, with the chloride being omitted in the instance of compositions for striping silver. Of the two auxiliary agents, lead compounds have been found preferable for most applications. The auxiliary agent may vary from as little as 0.01 percent to as much as 0.5 percent by weight of the dry powder composition. Amounts in excess of 0.5 percent have been found disadvantageous in that there is a tendency for the auxiliary agent to plate out upon the surface of the workpiece being plated. The function of the auxiliary agent is not fully understood but it does accelerate the stripping rate.

Lastly, the dry powder composition must contain an alkali metal or ammonium cyanide to chelate the metal being stripped from the surface of the workpiece. Of the various cyanide salts, potassium cyanide has been most advantageously employed. The cyanide salt will comprise the remainder of the composition and will normally be within the range of 78.0–95.0 percent and preferably 80.0–85.0 percent.

The dry powder composition is dissolved in water readily to form the aqueous stripping solution. The amount added to form a stripping solution may vary from as little as 7.5 grams per liter to 60.0 grams per liter and even more, but amounts in excess of 60.0 grams per liter do not afford any significant advantage and appear to effect economical operation. The preferred concentrations are at about 25.0–35.0 grams per liter.

As the stripping rate appears to decrease during the course of utilization of the stripping solution, it may be replenished by further additions of the dry powder composition, generally within the range of 5.0–30.0 grams per liter and preferably 10.0–20.0 grams per liter until there has been dissolved at least about 150 grams per liter of the dry powder composition and not more than about 200 grams per liter. At the 150–200 grams per liter level, the solution contains substantial amounts of dissolved precious metal and is no longer as effective in operation.

The precious metal values may be recovered from the solution by either electrolytic or chemical techniques. For example, the cyanide complex may be destroyed by any of the conventional techniques to precipitate the gold and permit its recovery by conventional procedures.

The stripping solution may be used at ambient to elevated temperatures but it affords its most significant advantages in terms of ease of operation at ambient to low elevated temperatures on the order of 18°–35° Centigrade. At temperatures above 55° Centigrade, the life of the stripping solution is materially reduced due to oxidation of the cyanide ion. The preferred temperatures of operation are within the range of 25°–35° Centigrade wherein stripping rates of 2.5 micrometers per minute may be readily attained.

The stripping solution may be brought into contact with the surface of the workpiece by any convenient means. Although spray techniques may be employed, the tendency for oxidation of the cyanide due to the greater solution/air interface generally makes immersion techniques more advantageous. The time of contact between the solution and the workpiece will vary depending upon the temperature, the concentration of the solution, and the thickness of the deposit to be removed. As indicated above, stripping rates of 2.5 micrometers per minute in the treatment of gold deposits are readily attained within the range of 25°–35° Centigrade and with concentrations on the order of 25.0–35.0 grams per liter of the dry powder composition. The stripping rate can be increased by increasing the temperature or by increasing the concentration; conversely, the stripping rate may be decreased by decreasing the temperature and/or the concentration.

Because of the highly corrosive nature of the stripping composition, the apparatus used to effect contact with the workpiece desirably employes a surface of stainless steel, polypropylene or a fiberglass reinforced resin inert to the stripping composition.

In practice, it has been found that gold and silver may be readily stripped from substrates comprising stainless steel, nickel, molybdenum and and alloys of iron, nickel, cobalt and manganese. When the composition is utilized for stripping precious metals from a copper substrate, the period of immersion should be closely controlled since it will attack the copper substrate.

Illustrative of the present invention are the following specific examples:

EXAMPLE ONE

A dry powder composition is prepared from 17.5 parts of potassium 2-chloro-4-nitrobenzoate, 0.15 part lead acetate, 0.15 part lithium carbonate and the remainder (82.2 parts) potassium cyanide. To water in a polypropylene tank is added the dry powder composition in an amount equal to 30.0 grams per liter and the solution is then held at a temperature of 30° Centigrade.

Workpieces comprising a substrate of kovar electroplated with gold to a depth of 1.5 micrometers are immersed in the stripping solution and are found to be stripped completely after 30 seconds without any evidence of attack upon the kovar substrate.

EXAMPLE TWO

The test of Example One is repeated substantially as described therein with the exception that potassium 3-methyl-6-nitrobenzoate is substituted for the chloronitrobenzoate of Example One. Similar results are obtained except that the period for complete dissolution is found to be about 50 seconds.

From the foregoing detailed specification and examples, it will be readily appreciated that the dry powder compositions of the present invention produce highly effective solutions for stripping gold and silver from substrates of nickel, kovar, stainless steel and molybdenum without appreciable attack upon those metals and may also be used for stripping such precious metals from copper substrates if the period of contact is controlled to minimize the attack upon copper. The stripping solutions may be formulated safely and readily from the dry powder composition and may be replenished from time to time until a relatively high concentration of the precious metal in the stripping solution has been attained. The precious metal values may be recovered conveniently and economically from the spent stripping composition.

Having thus described the invention, we claim:

1. A dry powder composition for addition to water to produce an aqueous solution for stripping gold and silver deposits from substrates and consisting essentially of, on a dry weight basis, 78.0–95.0 percent of a soluble cyanide compound selected from the group consisting of alkali metal cyanides, ammonium cyanide and mixtures thereof; 0.01–5.0 percent of a soluble lithium compound; 0.01–0.5 percent of an auxiliary agent comprising a soluble compound of a metal ion selected from the group consisting of lead, bismuth and mixtures thereof; and 5.0–22.0 percent of a water soluble, ring-substituted nitrobenzene acid compound selected from the group consisting af alkali metal and ammonium salts of methyl-nitrobenzoic acid, chloronitrobenzenesulfonamide, alkali metal and ammonium salts of amino nitrobenzoic acid, and alkali metal and ammonium salts of chloronitrobenzoic acid, said soluble lithium compound and auxiliary agent having non-interfering anions.

2. The dry powder composition in accordance with claim 1 wherein said ring-substituted nitrobenzene acid compound is an alkali metal salt of 2-chloro-4-nitrobenzoic acid.

3. The dry powder composition in accordance with claim 1 wherein said auxiliary agent is a lead salt.

4. The dry powder composition in accordance with claim 1 wherein said soluble cyanide compound comprises 80.0–85.0 percent, said lithium compound comprises 0.05–1.0 percent, said auxiliary agent comprises 0.05–0.25 percent; and said ring-substituted nitrobenzene acid compound comprises 12.0–20.0 percent.

5. The dry powder composition in accordance with claim 1 wherein said soluble cyanide compound is an alkali metal cyanide; wherein said auxiliary agent is a soluble lead salt, and wherein said ring-substituted nitrobenzene acid compound is an alkali metal salt of 2-chloro-4-nitrobenzoic acid.

6. In the method of stripping gold and silver deposits from substrates, the steps comprising:

A. dissolving in water 7.5–60.0 grams per liter of a dry powder composition consisting essentially of, on a dry weight basis, 78.0–95.0 percent of a soluble cyanide compound selected from the group consisting of alkali metal cyanides, ammonium cyanide and mixtures thereof; 0.01–5.0 percent of a soluble lithium compound; 0.01–0.5 percent of an auxiliary agent comprising a soluble compound of a metal ion selected from the group consisting of lead, bismuth and mixtures thereof; and 5.0–22.0 percent of a water soluble, ring-substituted nitrobenzene acid compound selected from the group consisting of alkali metal and ammonium salts of methylnitrobenzoic acid, chloro-nitrobenzenesulfonamide, alkali metal and ammonium salts of amino nitrobenzoic acid, and alkali metal and ammonium salts of chloronitrobenzoic acid, said soluble lithium compound and auxiliary agent having non-interfering anions;

B. maintaining the aqueous solution resulting therefrom at a temperature of 18°–55° Centigrade;

C. immersing in said aqueous solution a workpiece having a deposit of a metal selected from the group consisting of gold and silver for a period of time sufficient to remove said deposit; and D. rinsing said workpiece to remove said aqueous solution therefrom.

7. The method in accordance with claim 6 wherein said solution is maintained at a temperature of 25°–35° Centigrade.

8. The method in accordance with claim 6 wherein there is dissolved in water 25.0–35.0 grams per liter of dry powder composition.

9. The method in accordance with claim 6 wherein there is additionally dissolved in said aqueous solution on a periodic basis 5.0–30.0 grams per liter of said dry powder composition as the rate of stripping decreases until there has been dissolved in said aqueous solution a total of at least 150 grams per liter and not more than 200 grams per liter.

10. The method in accordance with claim 6 wherein said workpiece has a substrate of a metal selected from the group consisting of nickel, stainless steel, molybdenum and alloys of iron, nickel, cobalt and manganese.

11. The method in accordance with claim 6 wherein said metal deposit is gold and wherein the aqueous solution is subsequently treated to destroy the gold cyanide complex and precipitate gold.

* * * * *